US007171951B2

(12) United States Patent
Magel

(10) Patent No.: US 7,171,951 B2
(45) Date of Patent: Feb. 6, 2007

(54) FUEL INJECTION SYSTEM

(75) Inventor: Hans-Christoph Magel, Pfullingen (DE)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 11/266,223

(22) Filed: Nov. 4, 2005

(65) Prior Publication Data

US 2006/0090734 A1 May 4, 2006

(30) Foreign Application Priority Data

Nov. 4, 2004 (DE) ..... 10 2004 053 274

(51) Int. Cl.
*F02M 59/46* (2006.01)
*F02M 47/00* (2006.01)

(52) U.S. Cl. ..... 123/446; 123/467

(58) Field of Classification Search ..... 123/445, 123/446, 447, 179.17, 472, 506, 507, 179.7, 123/467; 239/88–96
See application file for complete search history.

(56) References Cited

U.S. PATENT DOCUMENTS 6,889,659 B2 * 5/2005 Magel ..... 123/446
6,962,141 B2 * 11/2005 Kern ..... 123/446

FOREIGN PATENT DOCUMENTS

WO WO2004/003378 * 1/2004

* cited by examiner

*Primary Examiner*—Andrew M. Dolinar
*Assistant Examiner*—Johnny H. Hoang
(74) *Attorney, Agent, or Firm*—Ronald E. Greigg

(57) ABSTRACT

A fuel injection system for an internal combustion engine including a fuel injector which can be subjected to fuel at high pressure and is actuatable via a metering valve device by which the pressure in a pressure booster control chamber is controllable such that the pressure in a pressure booster pressure chamber, defined by a pressure booster piston, that can be filled with fuel from the high-pressure fuel source via a filling path in which a check valve is disposed and that is in communication with an injection valve member pressure chamber, is increased by the pressure booster piston such that an injection valve member opens for injecting fuel, whereupon fuel is positively displaced out of a damping chamber via a damping path, in which a damping throttle is disposed. To assure stable injection performance, the damping path is embodied such and connected in such a way to the filling path that the fuel positively displaced from the damping chamber via the damping throttle in an injection event reaches the filling path of the pressure booster pressure chamber via the damping path.

20 Claims, 3 Drawing Sheets

FUEL INJECTION SYSTEM

CROSS-REFERENCE TO RELATED APPLICATIONS

This application is based on German Patent Application 10 2004 053 274.5 filed Nov. 4, 2004, upon which priority is claimed.

BACKGROUND OF THE INVENTION

1. Field of the Invention

The invention relates to an improved system for injecting fuel into a combustion chamber of an internal combustion engine, and more particularly to such a system having a fuel injector which can be subjected to fuel at high pressure via a high-pressure fuel source and which is actuatable via a metering valve device, by which device the pressure in a pressure booster control chamber is controllable such that the pressure in a pressure booster pressure chamber, defined by a pressure booster piston, that can be filled with fuel from the high-pressure fuel source via a filling path in which a check valve is disposed and that is in communication with an injection valve member pressure chamber, is increased by the pressure booster piston such that an injection valve member opens for injecting fuel, whereupon fuel is positively displaced out of a damping chamber via a damping path, in which a damping throttle is disposed.

2. Description of the Prior Art

From German Published Patent Disclosure DE 102 29 415 A1, a system for injecting fuel into a combustion chamber of an internal combustion engine is known, having a fuel injector which can be subjected to fuel at high pressure via a high-pressure source and which is actuatable via a metering valve. An injection valve member, which is urged in the closing direction by a closing force, is surrounded by a pressure chamber. To damp the opening speed of the injection valve member, such as a nozzle needle, without impairing its fast closure, the injection valve member is assigned a damping element that is movable independently of it and that defines a damping chamber and has at least one overflow conduit for connecting the damping chamber with a further hydraulic chamber. The damping element may be embodied as a damping piston, which is surrounded by the further hydraulic chamber.

OBJECT AND SUMMARY OF THE INVENTION

The object of the invention is to create a system for injecting fuel into a combustion chamber of an internal combustion engine, having a fuel injector, which can be subjected to fuel at high pressure via a high-pressure fuel source and is actuatable via a metering valve device, by which device the pressure in a pressure booster control chamber is controllable such that the pressure in a pressure booster pressure chamber, defined by a pressure booster piston, that can be filled with fuel from the high-pressure fuel source via a filling path in which a check valve is disposed and that is in communication with an injection valve member pressure chamber, is increased by the pressure booster piston such that an injection valve member opens for injecting fuel, whereupon fuel is positively displaced out of a damping chamber via a damping path, in which a damping throttle is disposed, which fuel injection system can be produced economically and assures stable injection performance.

In a system of this type, this object is attained in that the damping path is embodied such and connected in such a way to the filling path that the fuel positively displaced from the damping chamber via the damping throttle in an injection event reaches the filling path of the pressure booster pressure chamber via the damping path. The damping chamber, which may be defined by a separate damping piston or by the injection valve member, and the damping path with the damping throttle are also called a damping module. In the context of the present invention, it was discovered that in operation of the fuel injection system, the temperature in the damping module rises. The temperature increase in the damping module can be ascribed to the compression of the fuel volume enclosed in the damping chamber and to the depressurization losses in the damping throttle. The increased temperature in the damping module can lead to variable damping properties and instable injection performance. By the connection according to the invention of the damping path to the filling path, it is attained that the heated fuel, positively displaced out of the damping chamber, reaches the pressure booster pressure chamber the next time the pressure booster pressure chamber is filled via the filling path and is consequently injected. The heated fuel accordingly does not remain in the damping module. In the context of the present invention, the term "line" is understood to mean the same as the term "flow connecting means". That is, a line as understood in the invention may also be a bore or a conduit.

A preferred exemplary embodiment of the fuel injection system is characterized in that the filling path includes a filling path portion which connects the check valve with a control line that is in communication, via the metering valve device, with the high-pressure fuel source. Via the control line and the filling path portion, fuel subjected to high pressure reaches the pressure booster pressure chamber as a function of the switching position of the metering valve device.

A further preferred exemplary embodiment of the fuel injection system is characterized in that the filling path includes a filling path portion which connects the check valve with an injection valve member spring chamber that is in communication, via the metering valve device, with the high-pressure fuel source. Via the injection valve member spring chamber and the filling path portion, fuel subjected to high pressure reaches the pressure booster pressure chamber as a function of the switching position of the metering valve device.

A further preferred exemplary embodiment of the fuel injection system is characterized in that the damping path discharges into the filling path portion. Preferably, the damping path is markedly shorter than the filling path, and in particular shorter than the filling path portion.

A further preferred exemplary embodiment of the fuel injection system is characterized in that the damping chamber is defined by a damping piston which has a damping chamber filling path by way of which the damping chamber is filled. The damping chamber filling path that is independent of the damping path assures that the damping chamber is filled with new, cold fuel. Good rinsing out of the damping chamber is thus assured.

A further preferred exemplary embodiment of the fuel injection system is characterized in that the damping chamber is defined, in a damping chamber defining sleeve, by the end of the injection valve member remote from the combustion chamber. This has the advantage that a separate damping piston can be dispensed with.

A further preferred exemplary embodiment of the fuel injection system is characterized in that the damping chamber is in communication with the control line via a damping chamber filling path. The damping chamber filling path that is dependent on the damping path assures that the damping chamber is filled with new, cold fuel. Good rinsing out of the damping chamber is thus assured.

A further preferred exemplary embodiment of the fuel injection system is characterized in that a throttle and a check valve are disposed in the damping chamber filling path. It is thus assured, among other things, that no fuel from the damping chamber can escape via the damping chamber filling path.

Further preferred exemplary embodiments of the fuel injection system are characterized in that the metering valve device and/or the injection valve member and/or the pressure booster piston is integrated with the fuel injector. As a result, a compact, multi-functional injector is created.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
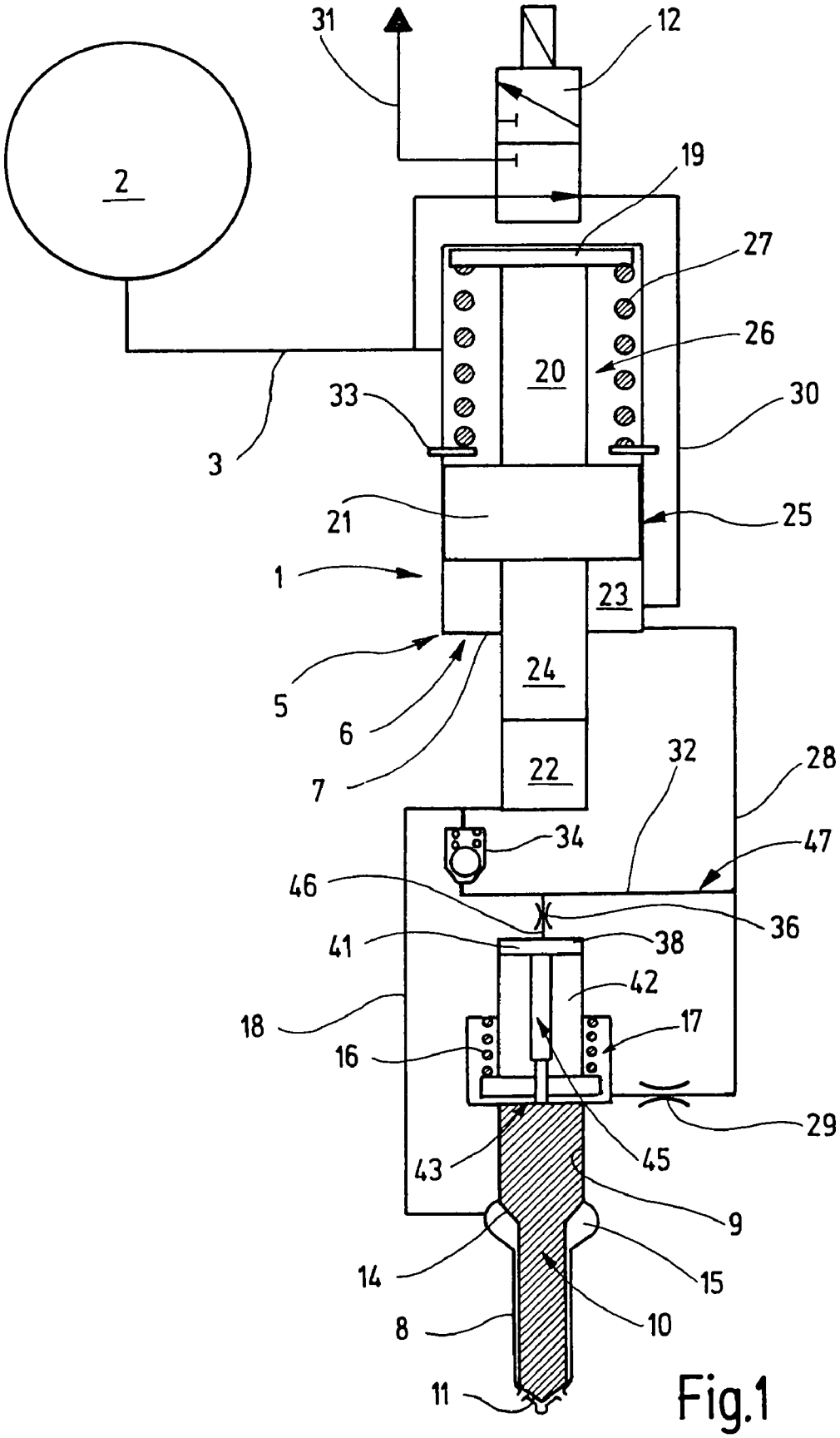
FIG. 1 is a schematic illustration of a fuel injection system of the invention, in a longitudinal section through an injector in the state of repose, in a first exemplary embodiment.
Figure 2:
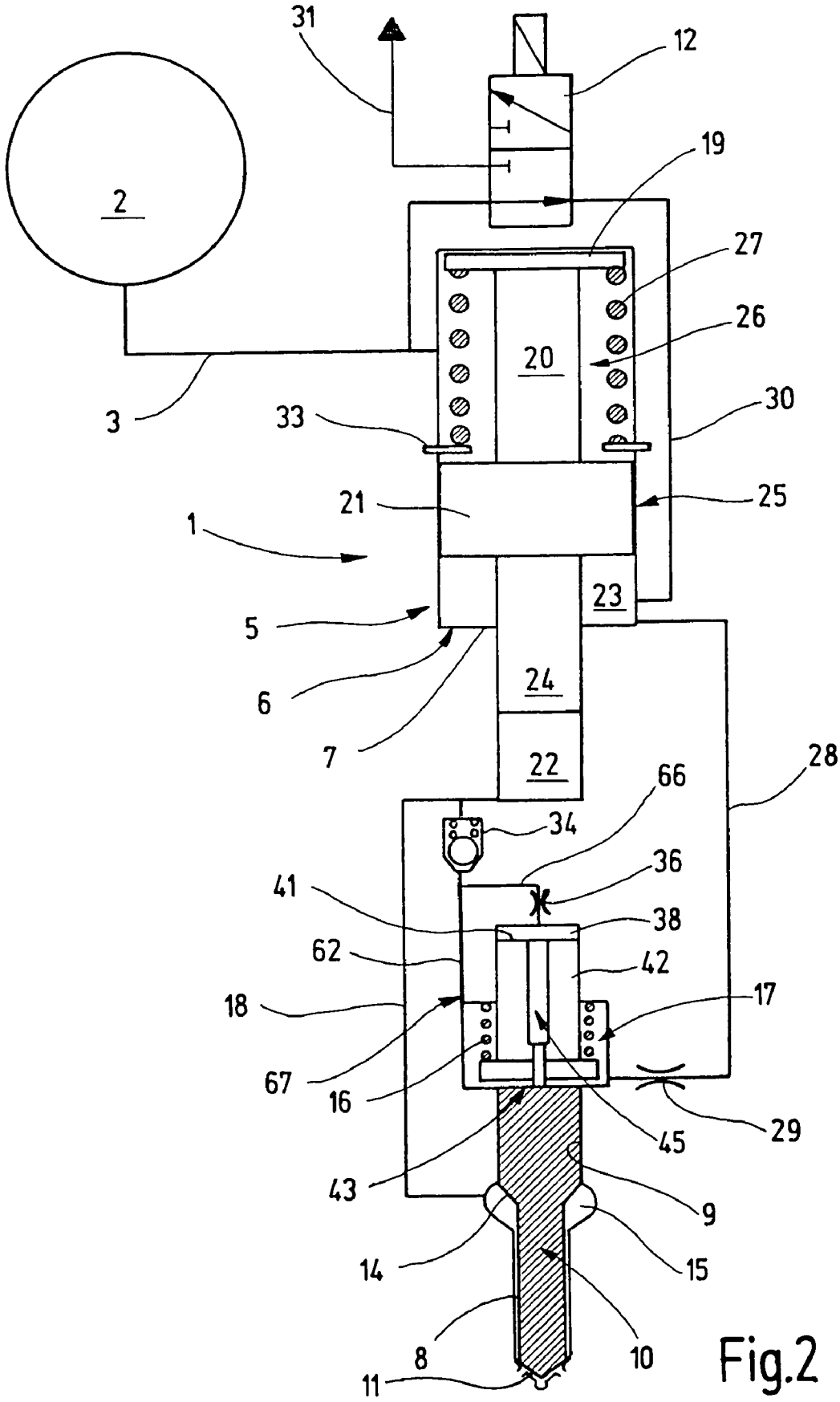
FIG. 2 shows a similar fuel injection system to FIG. 1, in a second exemplary embodiment.

In FIGS. 1 and 2, a longitudinal section in shown through a common rail injector 1, which is supplied with fuel that is at high pressure via an only schematically shown high-pressure reservoir 2, also known as a common rail or as a high-pressure fuel source. From the interior of the high-pressure reservoir 2, a fuel supply line 3 leads to a pressure booster 5, and is integrated with the fuel injector 1. The pressure booster 5 is surrounded by an injector housing 6, which is shown only schematically in FIGS. 1 and 2.

The injector housing 6 includes an injector body 7, only the interior of which is shown in FIGS. 1 and 2, and a nozzle body 8, which has a central guide bore 9. An injection valve member 10, also known as a nozzle needle, is guided movably back and forth in the guide bore 9. The nozzle needle 10 has a tip 11, on which a sealing face is embodied that cooperates with a sealing seat embodied on the end of the nozzle body 8 that protrudes into the combustion chamber. When the tip 11 of the nozzle needle 10 is resting with its sealing face on the sealing seat, at least one injection port and in particular a plurality of injection ports in the nozzle body 8 are closed.

When the nozzle needle tip 11 lifts from its seat, then fuel subjected to high pressure is injected through the injection ports into the combustion chamber of the engine. The opening motion of the nozzle needle 10 is controlled via a metering valve device 12, which in turn is triggered via a magnet valve. The metering valve device 12 is a 3/2-way valve which is integrated with the fuel injector 1.

A pressure shoulder 14 is embodied on the nozzle needle 10 and is disposed in a pressure chamber 15, also called an injection valve member pressure chamber, in the nozzle body 8. The nozzle needle 10 is prestressed by a nozzle spring 16 with its tip 11 against the associated nozzle needle tip. The nozzle spring 16 is received in a nozzle spring chamber 17, which is recessed out of the injector body 7. Via a connecting conduit 18, the nozzle spring chamber 17 communicates with a pressure booster pressure chamber 22.

The pressure booster pressure chamber 22 is formed by a portion of a central bore in the injector body 7 that is embodied, toward the combustion chamber, as a blind bore. On its end remote from the combustion chamber, the bore widens to form a pressure booster control chamber 23. In the blind bore, one end 24 of a pressure booster piston 25 is received such that it is movable back and forth. The end 24 of the pressure booster piston 25 has the form of a circular cylinder, which has a smaller diameter than an adjoining collar 21 of the pressure booster piston 25. From the face end of the collar 21 remote from the combustion chamber, a plunger 20, on whose end a spring plate 19 is embodied, protrudes into a pressure booster work chamber 26, which is in communication with the high-pressure fuel source 2 via the fuel supply line 3.

The pressure booster pressure chamber 22 is defined by the end, toward the combustion chamber, of the circular cylinder 24 of the pressure booster piston 25. The pressure booster control chamber 23 has the form of an annular chamber, which extends around the circular cylinder 24 into the injector body 7 and is defined by the end face, toward the combustion chamber, of the collar 21 of the pressure booster piston 25. The end face remote from the combustion chamber of the collar 21 of the pressure booster piston 25 defines the pressure booster work chamber 26. A nozzle spring 27 is fastened between the spring plate 19 and a stop 33 structurally connected to the injector housing, and by this spring the end of the pressure booster piston 25 remote from the combustion chamber is prestressed against the injector housing.

The pressure booster control chamber 23 is in communication with the nozzle spring chamber 17 via a control line 28 in which a throttle 29 is provided. The pressure booster control chamber 23 is also in communication with the high-pressure reservoir 2, via a connecting line 30 and the metering valve 12 as well as the supply line 3. In the position of the metering valve 12 shown in FIG. 1, the pressure booster piston 25 is in pressure equilibrium, and the injector 1 is in the state of repose.

When the metering valve 12 is put into its second position, the connecting line 30 is then made to communicate with a return line 31, which is in communication with a low-pressure region. A connecting line 32, in which a check valve 34 is disposed, originates at the control line 28 and discharges into the connecting conduit 18, which communicates with the pressure booster pressure chamber 22. Via the connecting line 32 and the check valve 34, the pressure booster pressure chamber 22 is filled with fuel from the high-pressure reservoir 2. The check valve 34 prevents a reverse flow of fuel out of the pressure booster pressure chamber 22.

From the connecting line 32, a connecting line with a throttle 36 leads into an injection valve member control chamber 38, which is defined in the nozzle body 8 by the end 41, remote from the combustion chamber, of a damping piston 42. The end 43 of the damping piston 42 toward the combustion chamber is embodied spherically and rests on the end of the nozzle needle 10 remote from the combustion chamber. In the state shown, a central through bore 45 is closed by a throttle in the damping piston 42. The damping piston 42 is pressed with its end 43 toward the combustion chamber against the end of the nozzle needle 10 remote from the combustion chamber by the nozzle spring 16.

FIGS. 1 and 2 show similar fuel injection systems. The same reference numerals are therefore used to designate the same elements. The differences between the two exemplary embodiments will now be discussed below.

In the exemplary embodiment shown in FIG. 1, a damping path in which the throttle 36 is disposed is identified by reference numeral 46. The damping path 46 discharges into the connecting line 32 that extends between the check valve 34 and the control line 28. A filling path for the pressure booster pressure chamber 22 is identified by reference numeral 47 in FIG. 1.

In the exemplary embodiment shown in FIG. 2, a connecting line 62 (instead of the connecting line 32 in FIG. 1) extends from the check valve 34 into the nozzle spring chamber 17. A damping path in which the damping throttle 36 is disposed is identified by reference numeral 66 in FIG. 2 and discharges into the connecting line 62. A filling path is identified by reference numeral 67 in FIG. 2.

The fuel injector 1 shown in FIGS. 1 and 2 is controlled via the 3/2-way valve 12. In the deactivated state of repose of the injector 1, the pressure booster control chamber 23, via the connecting line 30 and the metering valve 12, is subjected to the same system pressure of the pressure booster work chamber 26. The communication with the return 31 is closed. The pressure booster piston unit 25 is in pressure equilibrium, and no pressure boosting takes place. The nozzle needle 10 is closed.

For activating the injector 1, the pressure booster control chamber 23 is pressure-relieved. To that end, the pressure booster control chamber 23 is uncoupled from the pressure source 2 and is pressure-relieved into the return 31 via the connecting line 30. The pressure in the pressure booster pressure chamber 22 is increased in accordance with the boosting ratio of the pressure booster 25 and carried onward, via the connecting line 18, into the pressure chamber 15 at the nozzle needle 10. The nozzle needle 10 begins to open, whereupon fuel from the damping chamber 38 must be positively displaced via the throttle 36. As a result, the needle opening speed is reduced. The fuel that heats up upon depressurization via the throttle 36 into the damping path 46; 66 is carried into the filling path 47; 67 upstream of the check valve 34.

As long as the pressure booster control chamber 23, which can also be called a differential pressure chamber of the pressure booster piston 25, is pressure-relieved, the pressure booster 25 remains activated and compresses the fuel in the pressure booster pressure chamber 22. The compressed fuel is carried onward to the nozzle needle 10 and injected.

For terminating the injection, the differential pressure chamber 23 is disconnected from the return 31 by the control valve 12, and is subjected to the supply pressure of the high-pressure fuel source 2. As a result, rail pressure builds up in the connecting line 30 and the differential pressure chamber 23. Simultaneously, the pressure in the pressure booster pressure chamber 22 and in the pressure chamber 15 drops to rail pressure. The nozzle needle 10 closes. In the process, the nozzle needle 10 separates from the damping piston 42 and executes a fast closing motion.

The damping piston 42 is then restored by the nozzle spring 16. In that process, the damping chamber 38 is filled via the central through bore 45, which is also called the damping chamber filling path, and the opened sealing seat between the damping piston 42 and the nozzle needle 10. The damping chamber filling path 45 is connected to the control line 28 in such a way that the filling is done with new, cold fuel. The result is a forced thorough rinsing of the damping chamber 38.

After the pressure equalization of the system, the pressure booster piston 25 is returned to its outset position by the pressure booster spring 27, and the pressure booster pressure chamber 22 is filled via the filling path 47; 67 having the check valve 34. This filling stream is embodied such that by means of it, the heated quantity is pumped out of the damping chamber 38, or the damping path 46; 66, into the pressure booster pressure chamber and consequently injected.

Figure 3:
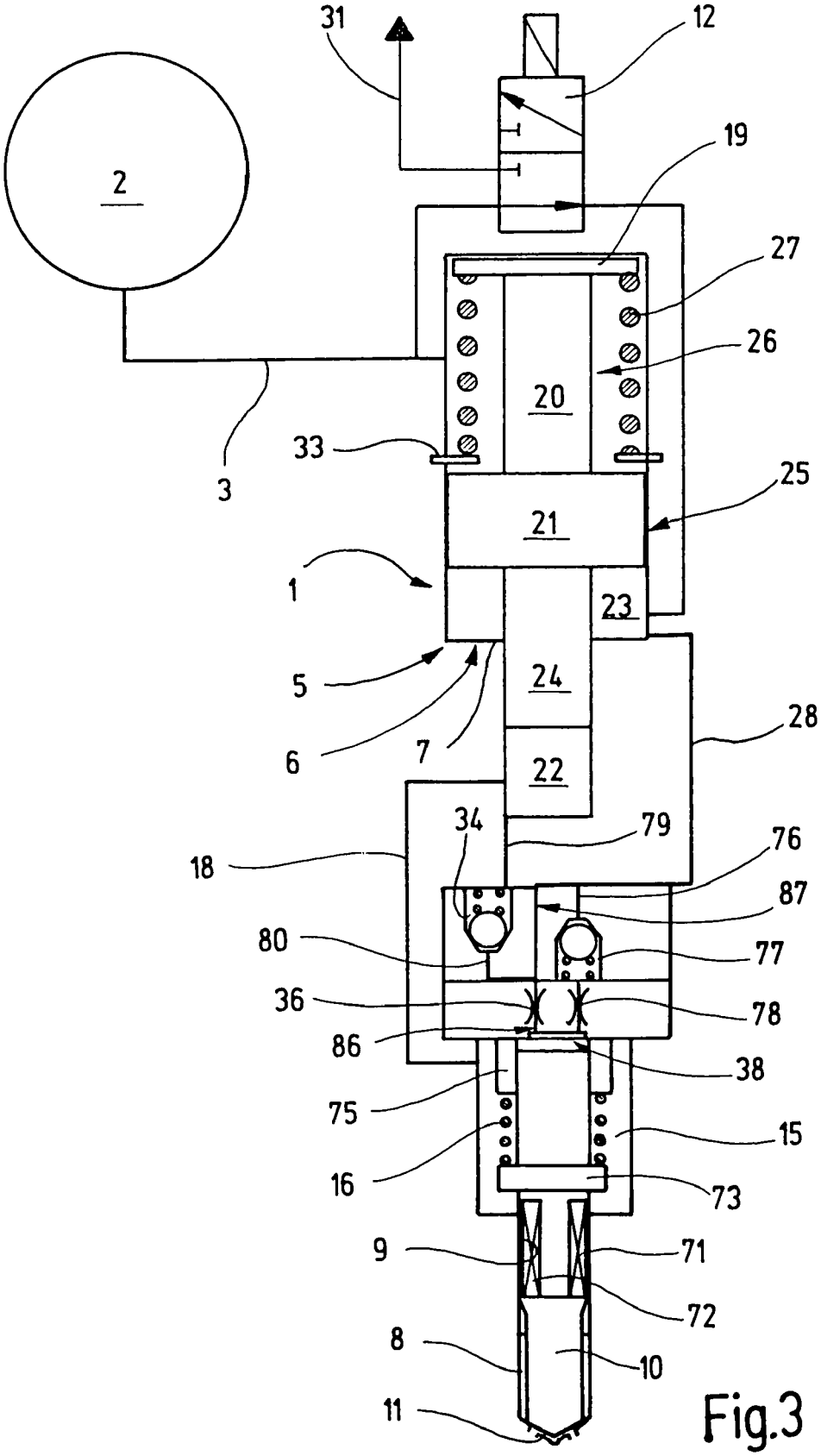
FIG. 3 shows a similar fuel injection system to that of FIGS. 1 and 2, in a third exemplary embodiment.

In FIG. 3, a similar fuel injection system to those in FIGS. 1 and 2 is shown. The same reference numerals are used for identifying identical elements. To avoid repetition, reference is made to the above description of FIGS. 1 and 2. Only the differences between the individual exemplary embodiments will be addressed below.

In the exemplary embodiment shown in FIG. 3, a different nozzle needle 10 is used, and the damping piston (42 in FIGS. 1 and 2) is dispensed with. In the exemplary embodiment shown in FIG. 3, flat faces 71, 72 are embodied on the nozzle needle 10, and fuel can flow past these faces from the pressure chamber 15 to reach the tip 11 of the nozzle needle 10. The nozzle needle 10 has a collar 73, which is disposed in the pressure chamber 15. The end of the nozzle needle 10 remote from the pressure chamber is guided in a nozzle needle control chamber defining sleeve 75, which on its end remote from the combustion chamber has a biting edge that rests on part of the injector housing 6.

The nozzle needle control chamber defining sleeve 75 and the end of the nozzle needle 10 remote from the combustion chamber define the damping chamber 38. A damping chamber filling path 76 originates at the damping chamber 38 and discharges into the control line 28, and a check valve device 77 and a throttle 78 are disposed in this filling path 76. The check valve 34 is in communication via a connecting line 79 with the pressure booster pressure chamber 22. Via a connecting line 80, the check valve 34 is in communication with the control line 28. The damping path is identified in FIG. 3 by reference numeral 86. The filling path is identified in FIG. 3 by reference numeral 87.

In the exemplary embodiment shown in FIG. 3, as in the preceding exemplary embodiments, upon opening of the nozzle needle 10 fuel is positively displaced out of the damping chamber 38 via the throttle 36 and depressurized, thereby damping the opening of the needle. The heated fuel is carried into the filling path via the damping path 86. Upon needle closure, the damping chamber 38 is filled via the damping chamber filling path 76 and the larger throttle 78, as a result of which new, cold fuel is introduced into the damping chamber 38.

The foregoing relates to preferred exemplary embodiments of the invention, it being understood that other variants and embodiments thereof are possible within the spirit and scope of the invention, the latter being defined by the appended claims.

I claim:

1. In a system for injecting fuel into a combustion chamber of an internal combustion engine, the system having a fuel injector which can be subjected to fuel at high pressure via a high-pressure fuel source and being actuatable via a metering valve device by which the pressure in a pressure booster control chamber is controllable such that the pressure in a pressure booster pressure chamber, defined by a pressure booster piston, that can be filled with fuel from the high-pressure fuel source via a filling path in which a check valve is disposed and that is in communication with an injection valve member pressure chamber, is increased by the pressure booster piston such that an injection valve member opens for injecting fuel, whereupon fuel is positively displaced out of a damping chamber via a damping path, in which a damping throttle is disposed, the improvement wherein the damping path is connected to the filling path and includes means for providing a flow path for the fuel positively displaced from the damping chamber via the damping throttle in an injection event to reach the filling path of the pressure booster pressure chamber via the damping path.

2. The fuel injection system as recited in claim 1, wherein the filling path includes a filling path portion connecting the check valve with a control line that is in communication, via the metering valve device, with the high-pressure fuel source.

3. The fuel injection system as recited in claim 1, wherein the filling path comprises a filling path portion connecting the check valve with an injection valve member spring chamber that is in communication, via the metering valve device, with the high-pressure fuel source.

4. The fuel injection system as recited in claim 2, wherein the damping path discharges into the filling path portion.

5. The fuel injection system as recited in claim 3, wherein the damping path discharges into the filling path portion.

6. The fuel injection system as recited in claim 1, wherein the damping chamber is defined by a damping piston, which has a damping chamber filling path by way of which the damping chamber is filled.

7. The fuel injection system as recited in claim 2, wherein the damping chamber is defined by a damping piston, which has a damping chamber filling path by way of which the damping chamber is filled.

8. The fuel injection system as recited in claim 3, wherein the damping chamber is defined by a damping piston, which has a damping chamber filling path by way of which the damping chamber is filled.

9. The fuel injection system as recited in claim 4, wherein the damping chamber is defined by a damping piston, which has a damping chamber filling path by way of which the damping chamber is filled.

10. The fuel injection system as recited in claim 1, wherein the damping chamber is defined in a damping chamber defining sleeve by the end of the injection valve member remote from the combustion chamber.

11. The fuel injection system as recited in claim 2, wherein the damping chamber is defined in a damping chamber defining sleeve by the end of the injection valve member remote from the combustion chamber.

12. The fuel injection system as recited in claim 3, wherein the damping chamber is defined in a damping chamber defining sleeve by the end of the injection valve member remote from the combustion chamber.

13. The fuel injection system as recited in claim 4, wherein the damping chamber is defined in a damping chamber defining sleeve by the end of the injection valve member remote from the combustion chamber.

14. The fuel injection system as recited in claim 10, wherein the damping chamber is in communication with the control line via a damping chamber filling path.

15. The fuel injection system as recited in claim 2, wherein the damping chamber is in communication with the control line via a damping chamber filling path.

16. The fuel injection system as recited in claim 10, further comprising a throttle and a check valve disposed in the damping chamber filling path.

17. The fuel injection system as recited in claim 1, wherein the metering valve device and/or the injection valve member and/or the pressure booster piston is integrated with the fuel injector.

18. The fuel injection system as recited in claim 2, wherein the metering valve device and/or the injection valve member and/or the pressure booster piston is integrated with the fuel injector.

19. The fuel injection system as recited in claim 3, wherein the metering valve device and/or the injection valve member and/or the pressure booster piston is integrated with the fuel injector.

20. The fuel injection system as recited in claim 4, wherein the metering valve device and/or the injection valve member and/or the pressure booster piston is integrated with the fuel injector.

* * * * *